US006675884B1

(12) United States Patent
Shen

(10) Patent No.: US 6,675,884 B1
(45) Date of Patent: Jan. 13, 2004

(54) ASSEMBLY OF MULTIPLE HEAT SINK FINS

(76) Inventor: Chi-Chang Shen, 1F, No. 1-1, Wang Tzu Street, Chung-Li City, Tayuang County (TW)

( * ) Notice: Subject to any disclaimer, the term of this patent is extended or adjusted under 35 U.S.C. 154(b) by 0 days.

(21) Appl. No.: 10/329,574

(22) Filed: Dec. 27, 2002

(51) Int. Cl.[7] ..... F28F 1/20; F28F 1/14; F28F 7/00; B21D 39/06

(52) U.S. Cl. ..... 165/181; 165/183; 165/76; 165/78; 29/890.04

(58) Field of Search ..... 165/181, 182, 165/183, 185, 76, 78, 80.1; 29/890.038, 890.04, 890.046, 890.047

(56) References Cited

U.S. PATENT DOCUMENTS 3,285,334 A * 11/1966 Pasternak ..... 165/172
3,443,634 A * 5/1969 Pasternak ..... 165/182
3,741,291 A * 6/1973 Limoni ..... 165/181
3,780,797 A * 12/1973 Gebelius ..... 165/182
4,928,756 A * 5/1990 Shull et al. ..... 165/182

FOREIGN PATENT DOCUMENTS

JP 404279234 A * 10/1992
JP 09096496 A * 4/1997
JP 02001091179 A * 4/2001

* cited by examiner

*Primary Examiner*—Henry Bennett
*Assistant Examiner*—Tho V Duong
(74) *Attorney, Agent, or Firm*—Troxell Law Office PLLC

(57) ABSTRACT

An assembly of multiple heat sink fins is comprised of multiple fins overlapped on one another and penetrated through by a heat conducting tube, each fin being provided at where close to the edge of the fin with a hole in a diameter slightly smaller than the outer diameter of the conducting tube to receive insertion of the conducting tube; an opening connected through the hole being formed on the edge of the fin; and the fin allowing the conducting tube being compressed into the hole through the opening as a clamp ring to secure the fin to the tube.

2 Claims, 5 Drawing Sheets

ASSEMBLY OF MULTIPLE HEAT SINK FINS

BACKGROUND OF THE INVENTION 1. (a) Field of the Invention

The present invention is related to a structure of an assembly of multiple heat sink fins, and more particularly, to one adapted with heat conducting tubes to permit simplified assembly process of the heat sink and significantly improve heat evolution effect.

2. (b) Description of the Prior Art

As illustrated in FIGS. 1A and 1B of the accompanying drawings, a heat sink (A) of the prior art is comprised of multiple fins (A1) overlapped on one another and two heat conducting tubes (A2) penetrated each and all the fins. A hole (A11) is pre-bored on each fin (A1) to receive insertion of the tubes (A2) and a solder (A3) is place between the hole (A11) and the heat conducting tube (A2) and is heated to fuse the heat conducting tube (A2) with the fin (A1).

For the heat conducting tube (A2) to penetrate through those holes (A11) in each and all fins (A1), the diameter of the hole (A11) must be larger than the outer diameter of the heat conducting tube (A2). A very tiny pore (A12) must be provided in the inner edge of the hole (A11) to be filled with the solder (A3) so that the solder (A3) is properly held in position between the heat conducting tube (A2) and the fin (A1). However, the entire process appears to be very complicate involving insertion of the heat conducting tube (A2) through the hole (A11) in the fin (A1) and further insertion of the solder (A3) through the tiny pore (A12) in the fin (A1) with precise control of the heating time and temperature to make sure that the solder (A3) is fused, therefore, the product quality can be easily compromised. Furthermore, the binding between the heat conducting tube (A2) and the fin (A1) is vulnerable to be affected by the heat generated by the heat sink (A) in use.

SUMMARY OF THE INVENTION

The primary purpose of the present invention is to provide an assembly of multiple heat sink fins wherein each fin tightly clamping onto a heat conducting tube by having the conducting tube to insert through a hole provided in the fin. To achieve the purpose, the hole is provided at where close to the edge of the fin and an opening is formed on the edge of the fin with the diameter of the hole being slightly smaller than the outer diameter of the heat conducting tube.

Another purpose of the present invention is to provide an assembly of multiple heat sink fins wherein a lip is longitudinally provided to the heat conducting tube that is able to extend into the opening to guide the insertion of the heat conducting tube through the opening.

DETAILED DESCRIPTION OF THE PREFERRED EMBODIMENTS

Figures 1A, 1B:
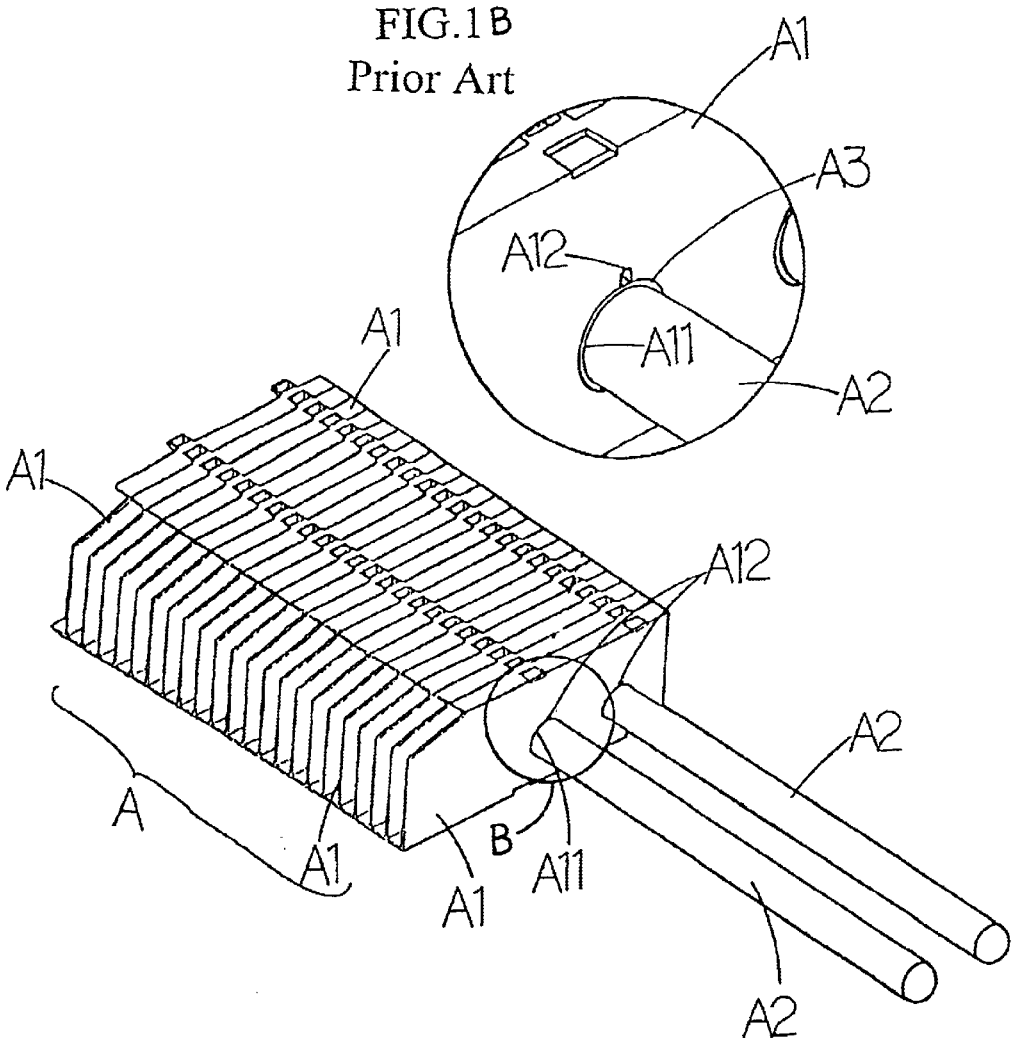
FIG.1B Prior Art
FIG.1A Prior Art
FIG. 1A is a schematic view showing an assembly of a heat sink of the prior art.
FIG. 1B is an enlargement of B in FIG. 1A.
Figure 2:
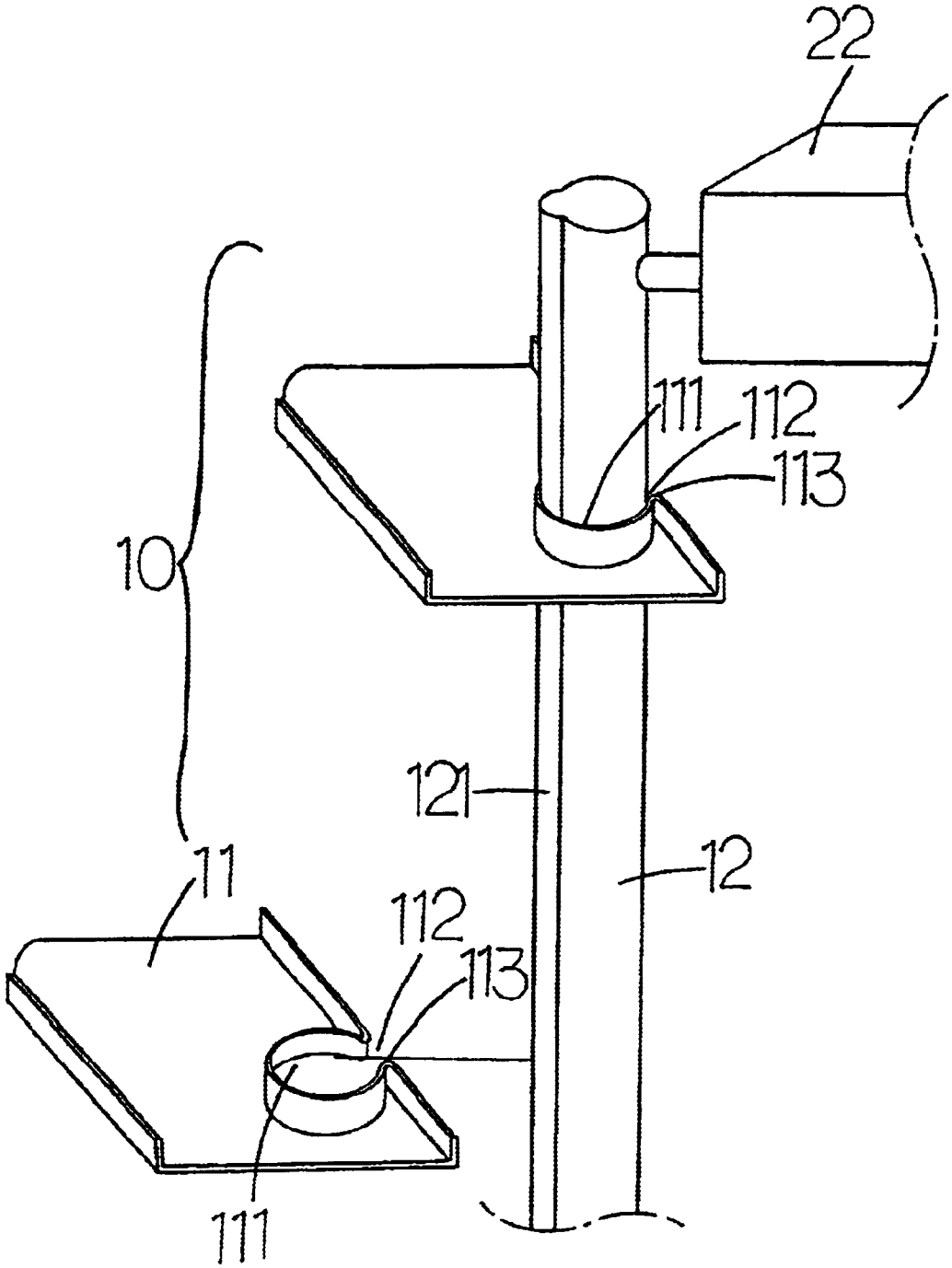
FIG. 2 is a schematic view showing an assembly of a heat sink of a preferred embodiment of the present invention.

Referring to FIG. 2, a heat sink (10) of a preferred embodiment of the present invention is comprised of multiple heat sink fins (11) overlapped on one another and a heat conducting tube (12) penetrating through all the fins (11). A hole (111) is pre-bored in each fin (11) to receive insertion of the heat conducting tube (12).

The hole (111) in a diameter slightly smaller than the outer diameter of the heat conducting tube (12) in the fin (11) is pre-bored at where close to the edge of the fin (11), and an opening (112) connected through the hole (111) is provided on the edge of the fin (11). Accordingly, each of those heat sink fins (11) of the heat sink (10) allows the heat conducting tube (12) be forced to enter into the hole (111) through the opening (112) and be tightly clamped by the fin (111) with the hole (111) functioning as a packing against the heat conducting tube (12).

Figure 3:
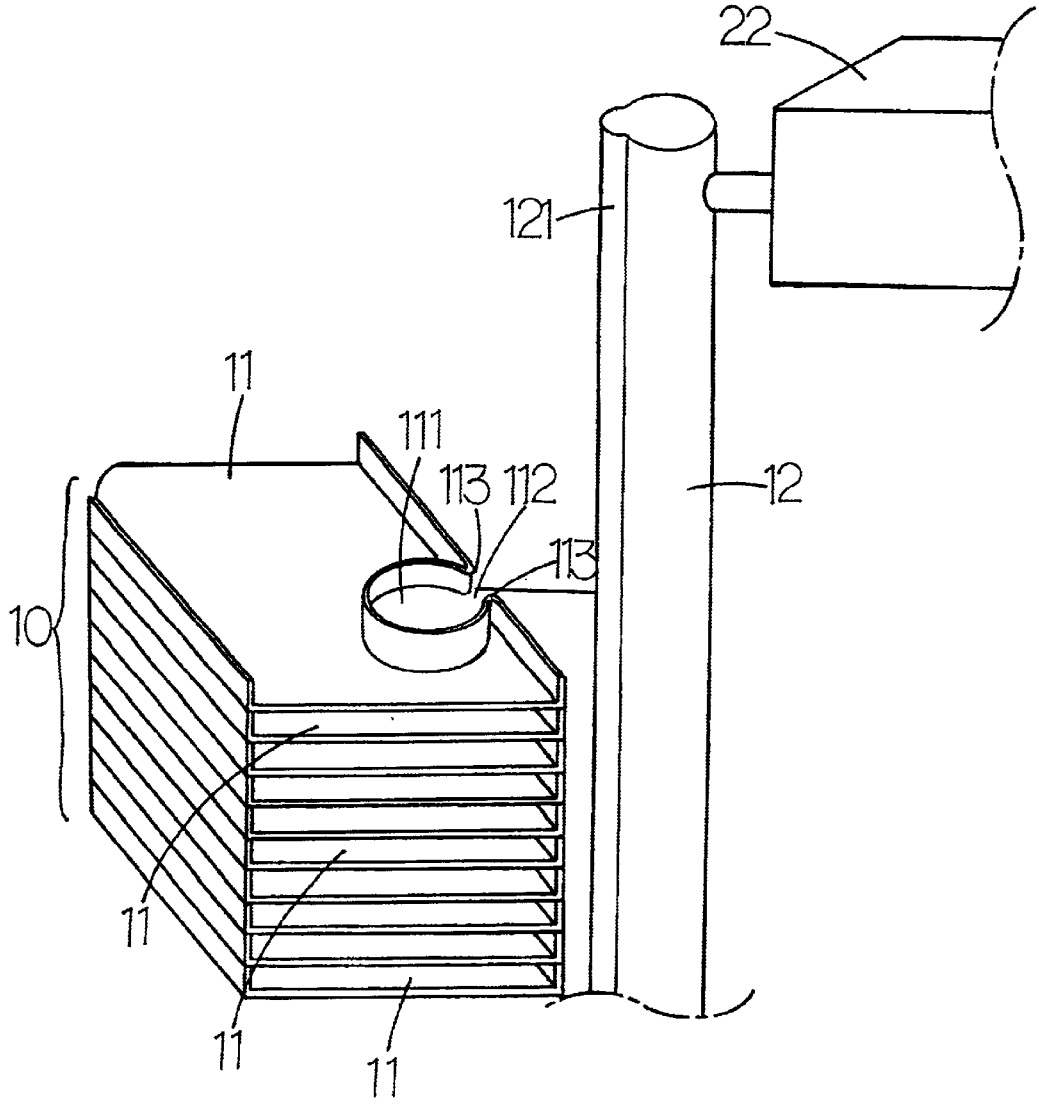
FIG. 3 is another schematic view showing an assembly of the preferred embodiment of the present invention.

As illustrated in FIG. 2, in the course of assembling the fin (11) and the heat conducting tube (12), all those fins (11) are inserted one by one through the heat conducting tube (12) and are overlapped on one another to form a complete configuration of the heat sink (10); or, alternatively as illustrated in FIG. 3, all fins (11) are first overlapped on one another, and then the heat conducting tube (12) is forced to penetrate the hole (111 ) of each fin (11) to complete the configuration of the heat sink (10). In either way, a lip (121) extending into the opening (112) is longitudinally provided along the heat conducting tube (12) so that upon assembling the heat conducting tube (12)through the fin (11), the lip (121) extends into the opening (112) first to guide the insertion of the heat conducting tube (12). A guiding angle (113) is further provided on the circumference of the opening (112) to facilitate the entry of the heat conducting tube (12) into the opening (112) for easier assembly of the heat conducting tube (12) and the fin (11).

Figure 4:
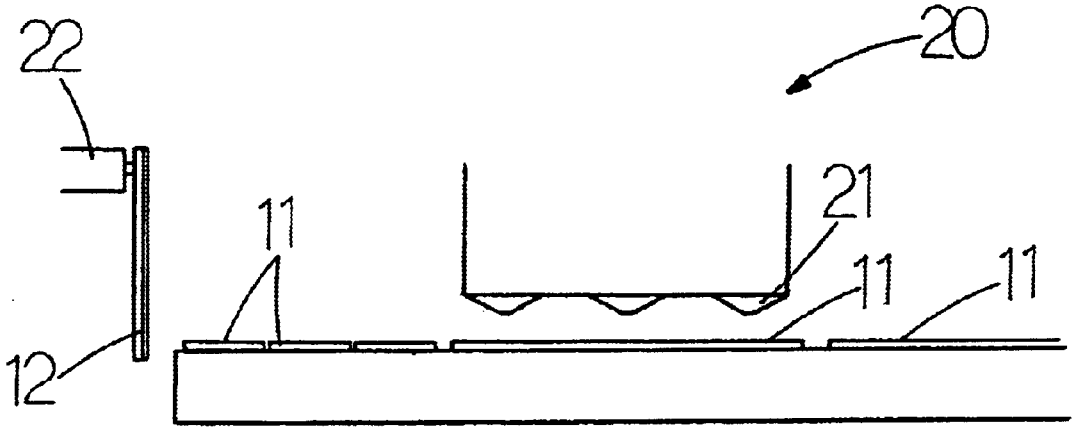
FIG. 4 is a schematic view showing the operation of a tooling set used in the process of the preferred embodiment of the present invention.
Figure 5:
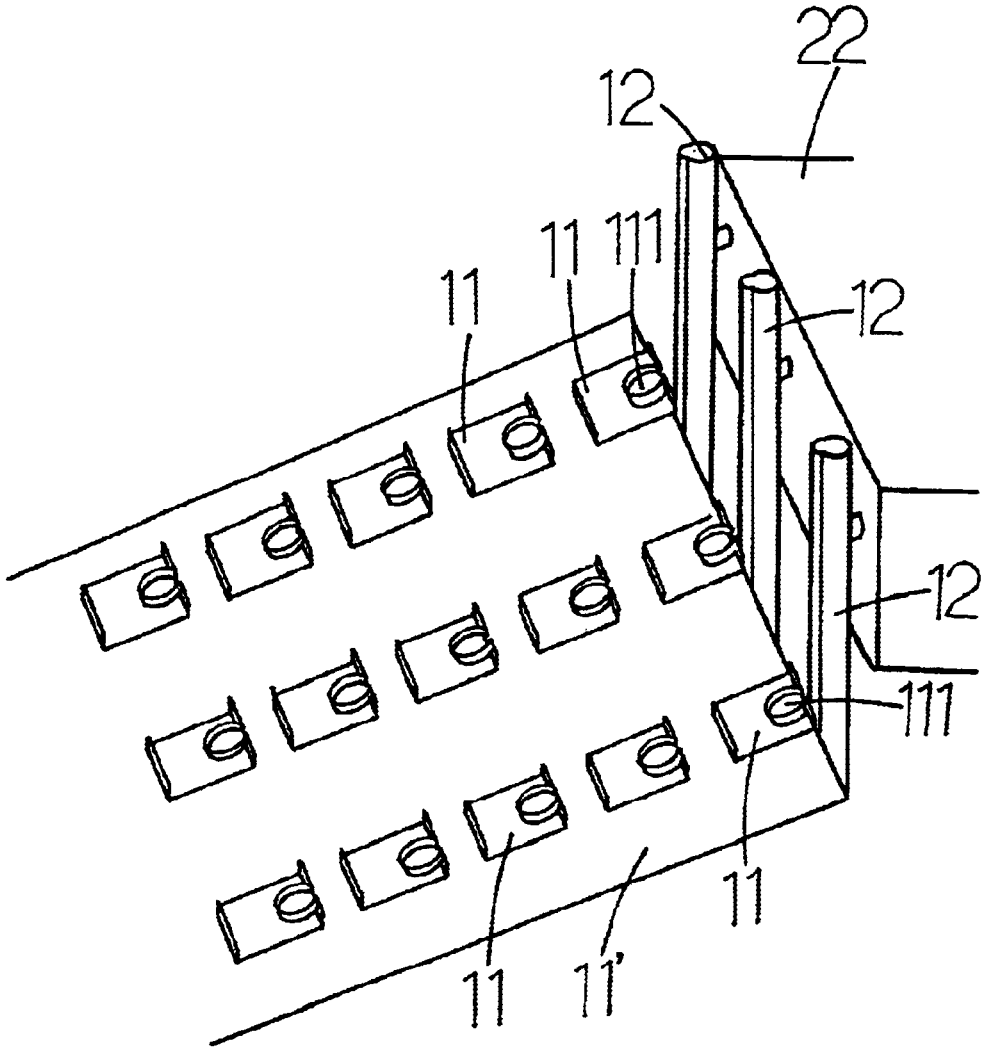
FIG. 5 is a schematic view showing the assembly process of the conducting tube and the fin by means of the tooling set.

Now referring to FIGS. 4 and 5, for the purposes of significantly reducing the resistance in penetrating the heat conducting tube (12) into the fin, and to incorporate the assembly process into the process of the fin (11), the heat conducting tube (12) is first mounted to a vice (22) of a tooling set (20) to receive insertion of each fin when completed with its production. Furthermore, depending on the process flow of a fin band (11'), a mold (21) is provided to press the fin band (11') and the vice (22) is used to first mount the heat conducting tube (12) for inserting it through the fin (11). Consequently, once the tooling set (20) is operating, the fin belt (11') is pressed into multiple fins (11) while the heat conducting tube (12) inserts through the fin (11) in the same process to complete the production of the heat sink, thus to simplify the process and improve production capacity of the heat sink.

The present invention, by having disposed the hole in a diameter slightly smaller than the outer diameter of the heat conducting tube at where close to the edge of the fin and an opening connected through the hole provided on the edge of the fin to allow the heat conducting tube be forced into the hole through the opening to tightly clamp the heat conducting tube, provides an improved structure of an assembly of a heat sink, therefore, the application for a utility patent is duly filed accordingly.

I claim:

1. An assembly of multiple heat sink fins comprising:

a) a plurality of heat sink fins, each heat sink fin having a hole with an opening extending through an edge of the heat sink fin; and b) a heat conducting tube having a lip formed on an outer periphery and extending longitudinally along a length of the heat conducting tube such that, when the heat conducting tube is forcibly inserted through the hole in each of the plurality of heat sink fins, the lip of the heat conducting tube is positioned within the hole opposite the opening in each of the plurality of heat sink fins, wherein pressure between the plurality of heat sink fins and the heat conducting tube, including the lip, clamps the plurality of heat sink fins to the heat conducting tube.

2. The assembly of multiple heat sink fins according to claim 1, further comprising a guiding angle formed on the edge and extending around the opening and the hole in each of the plurality of heat sink fins.

* * * * *